US009711873B1

(12) United States Patent
Tanaka et al.

(10) Patent No.: US 9,711,873 B1
(45) Date of Patent: Jul. 18, 2017

(54) CRIMP TERMINAL AND CONNECTOR

(71) Applicant: JAPAN AVIATION ELECTRONICS INDUSTRY, LIMITED, Shibuya-ku, Tokyo (JP)

(72) Inventors: Daisuke Tanaka, Tokyo (JP); Takashi Ookawa, Tokyo (JP); Kiyohito Koide, Tokyo (JP); Hiroshi Akimoto, Tokyo (JP); Takaichi Teramoto, Tokyo (JP); Kazuomi Sato, Tokyo (JP); Hiroki Yokohama, Tokyo (JP); Nobuhisa Todo, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/359,840

(22) Filed: Nov. 23, 2016

(30) Foreign Application Priority Data

Dec. 28, 2015 (JP) ..... 2015-256632

(51) Int. Cl.
*H01R 4/18* (2006.01)
*H01R 13/11* (2006.01)
*H01R 13/50* (2006.01)

(52) U.S. Cl.
CPC ..... *H01R 4/188* (2013.01); *H01R 4/185* (2013.01); *H01R 13/114* (2013.01); *H01R 13/50* (2013.01)

(58) Field of Classification Search
CPC ..... H01R 4/188
USPC ..... 439/877, 882
See application file for complete search history.

(56) References Cited

U.S. PATENT DOCUMENTS

| | | | | |
|---|---|---|---|---|
| 6,056,605 | A * | 5/2000 | Nguyen | H01R 4/188 439/882 |
| 8,177,591 | B2 | 5/2012 | Okamura et al. | |
| 8,337,262 | B2 | 12/2012 | Ono et al. | |
| 8,425,266 | B2 | 4/2013 | Ono et al. | |
| 8,430,700 | B2 | 4/2013 | Ono et al. | |
| 8,622,774 | B2 * | 1/2014 | Seifert | H01R 4/188 439/882 |
| 9,130,284 | B2 | 9/2015 | Onuma et al. | |
| 9,196,972 | B2 | 11/2015 | Todo et al. | |
| 2016/0218445 | A1 | 7/2016 | Kondou et al. | |

FOREIGN PATENT DOCUMENTS

| | | | |
|---|---|---|---|
| JP | 2010027463 | A | 2/2010 |
| JP | 2010027505 | A | 2/2010 |
| JP | 2010272508 | A | 12/2010 |

(Continued)

*Primary Examiner* — Tho D Ta
(74) *Attorney, Agent, or Firm* — Holtz, Holtz & Volek PC

(57) ABSTRACT

A crimp terminal has a crimp barrel which is crimped onto a core wire of a cable. The crimp barrel has an inner surface in which a plurality of cavities which are independent from one another is formed. Each of the cavities has a predetermined shape in a plane orthogonal to a depth direction thereof before the crimp barrel is crimped onto a core wire. The predetermined shape has at least two straight portions and a concave curved portion connecting the straight portions. The concave curved portion is indented inward of the predetermined shape. A plurality of the concave curved portions which are close to each other and included respectively in the predetermined shapes distinct from each other is arranged on an identical imaginary circle or rounded rectangular.

6 Claims, 8 Drawing Sheets

(56) References Cited

FOREIGN PATENT DOCUMENTS

| | | | |
|---|---|---|---|
| JP | 2012038453 | A | 2/2012 |
| JP | 2015076236 | A | 4/2015 |
| JP | 2015106428 | A | 6/2015 |
| JP | 2015130311 | A | 7/2015 |

* cited by examiner

CRIMP TERMINAL AND CONNECTOR

CROSS REFERENCE TO RELATED APPLICATIONS

This application is based on and claims priority under 35 U.S.C. §119 to Japanese Patent Application No. JP2015-256632 filed Dec. 28, 2015, the contents of which are incorporated herein in their entirety by reference.

BACKGROUND OF THE INVENTION

This invention relates to a crimp terminal and a connector provided with the same.

A crimp terminal, which is to be connected to an easily oxidizable core wire such as a core wire made of aluminum or aluminum alloy, is formed with a serration to break an oxide film formed on a surface of the core wire. A crimp terminal of this type is disclosed in JPA 2010-27463 (Patent Literature 1), for example. Referring to FIGS. 14 and 15, a crimp terminal 95 of Patent Literature 1 has a crimp barrel 911 with an inner surface 912. The inner surface 912 is formed with a serration 914 having a plurality of cavities 915. As shown in FIG. 15, the cavities 915 of the serration 914 of Patent Literature 1 have a shape of an approximately parallelogram in a plane orthogonal to a depth direction of the cavities 915. In detail, opposite angles, which have an acute angle and form one of two pairs of opposite angles of the parallelogram, are rounded. In other words, the shape of the cavities 915 of the serration 914 includes four straight portions 951 and two curved portions 953 protruding outward in the crimp terminal 95 of Patent Literature 1. Owing to presence of the curved portions 953, the crimp terminal 95 of Patent Literature 1 has an advantage that connection stability is improved.

In order to form the serration of the crimp terminal, a die having protrusions corresponding to the cavities is used. In manufacturing the die, it requires labor and time to form shapes corresponding to the curved portions which are included in the shape of the cavities of the serration and protrude outward. That is, the crimp terminal of Patent Literature 1 has a problem that it requires labor and time to manufacture the die used for manufacturing the crimp terminal.

SUMMARY OF THE INVENTION

It is an object of the present invention to provide a crimp terminal having a serration structure which causes a die therefore to be easily manufactured even though a shape of cavities includes a curved portion.

One aspect of the present invention provides a crimp terminal which has a crimp barrel to be crimped onto a core wire of a cable. The crimp barrel has an inner surface in which a plurality of cavities which are independent from each other is formed. Each of the cavities has a predetermined shape in a plane orthogonal to a depth direction thereof before the crimp barrel is crimped. The predetermined shape has at least two straight portions and a concave curved portion connecting the straight portions to each other. The concave curved portion is indented inward of the predetermined shape. A plurality of the concave curved portions which are close to each other and included respectively in the predetermined shapes distinct from each other is arranged on an identical imaginary circle or rounded rectangular.

Another aspect of the present invention provides a connector which includes the crimp terminal and a holding member which holds the crimp terminal.

The predetermined shape of each of the cavities forming the serration includes the concave curved portions. In addition, the concave curved portions close to each other are arranged on the identical imaginary circle or rounded rectangular. Accordingly, it is easy to manufacture a die used for forming the serration.

An appreciation of the objectives of the present invention and a more complete understanding of its structure may be had by studying the following description of the preferred embodiment and by referring to the accompanying drawings.

Figure 1:
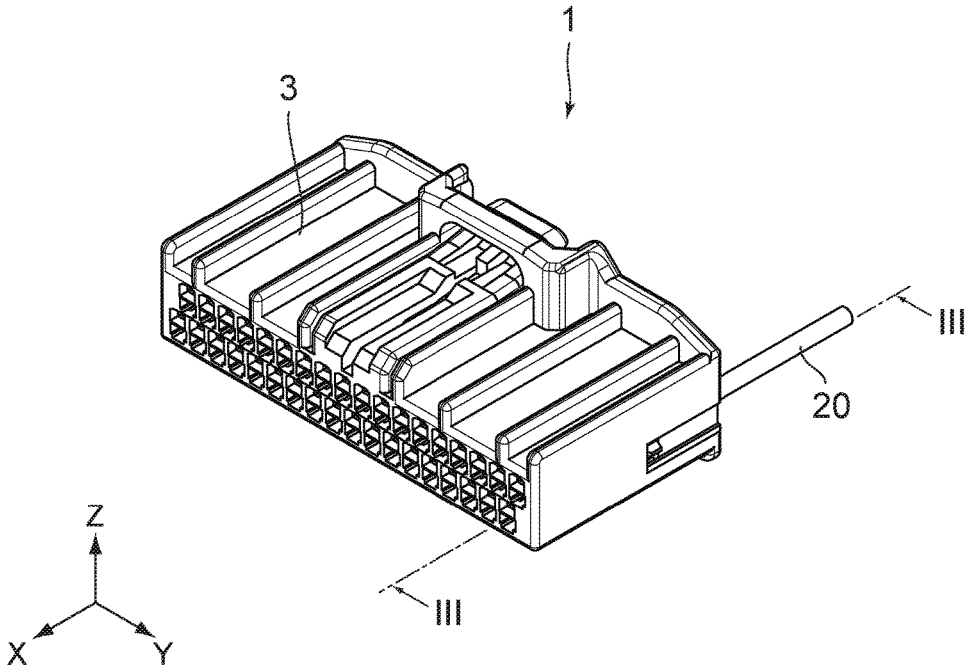
FIG. 1 is a perspective view showing a connector according to a preferred embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
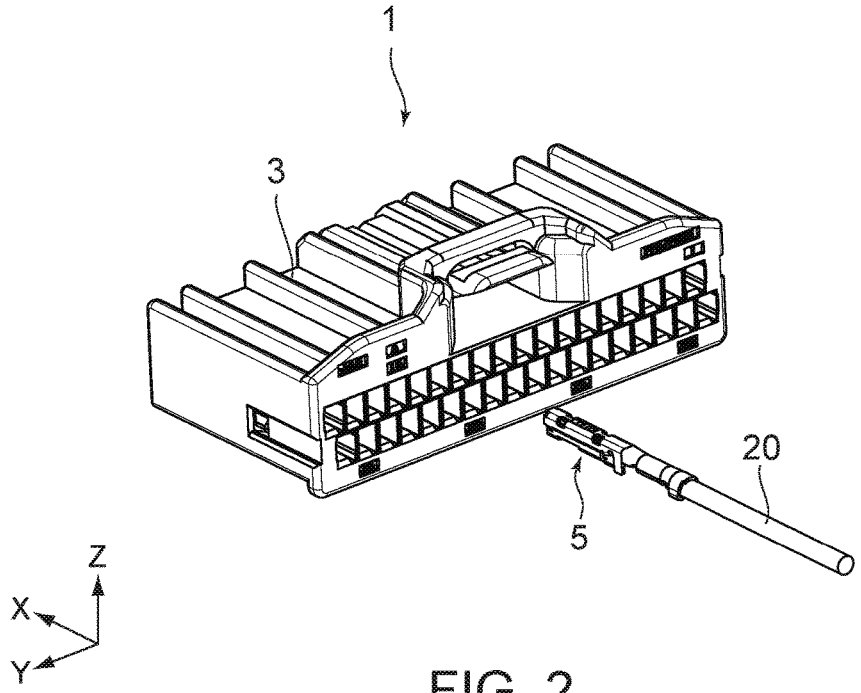
FIG. 2 is an exploded perspective view showing the connector of FIG. 1.
Figure 3:
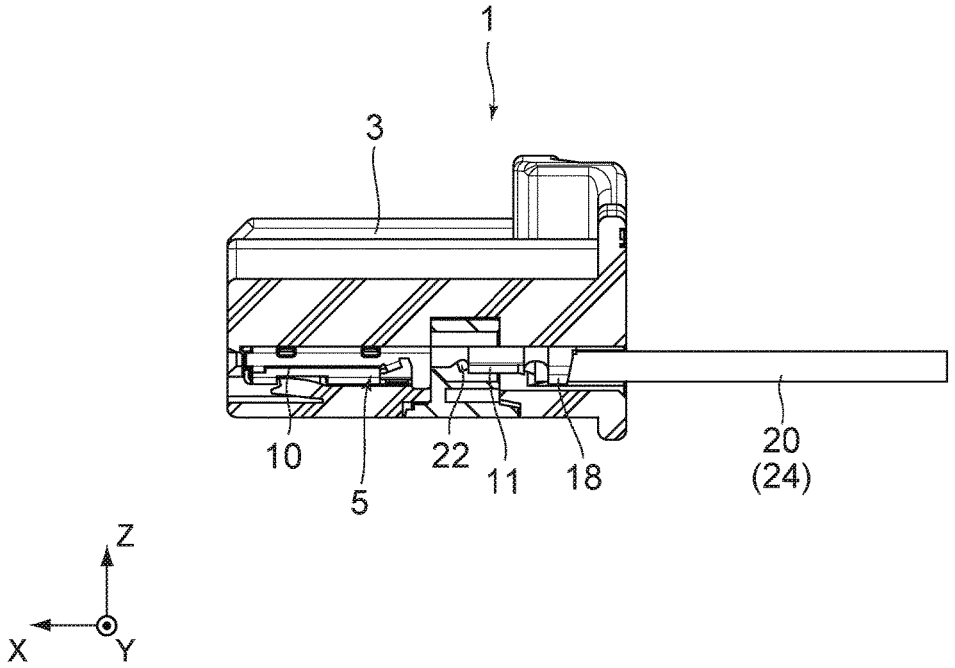
FIG. 3 is a cross-sectional view showing the connector of FIG. 1, taken along III-III line.
Figure 4:
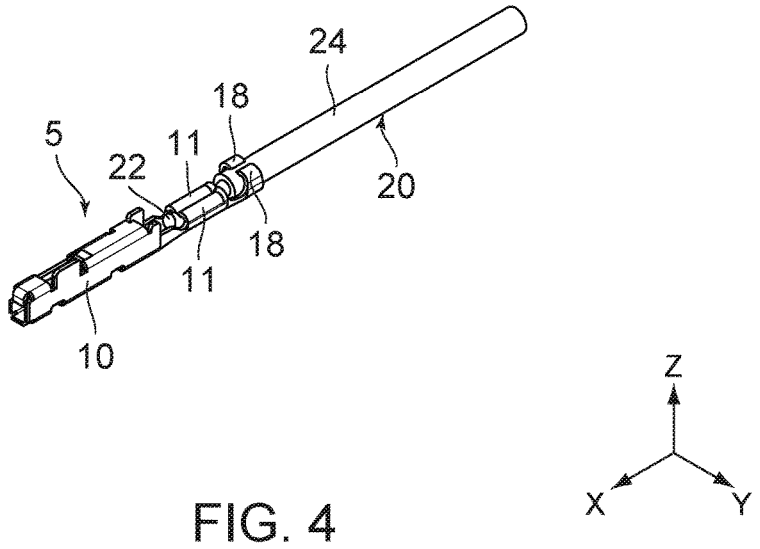
FIG. 4 is a perspective view showing a crimp terminal included in the connector of FIG. 2. To the crimp terminal, a cable is connected.

Referring to FIGS. 1 to 3, a connector 1 according to an embodiment of the present invention is provided with a holding member 3 made of insulator and a crimp terminal 5 made of conductor. Although the connector 1 is provided with a plurality of crimp terminals 5, just one of the crimp terminals 5 is shown in the figures. The crimp terminal 5 is inserted into the holding member 3 from the rear of the holding member 3 in a state where a longitudinal direction thereof coincides with a front-rear direction. Then the crimp terminal 5 is held by the holding member 3. In the present embodiment, the front-rear direction is an X-direction. Forward is a positive X-direction while rearward is a negative X-direction. To the crimp terminal 5, a cable 20 is connected. As shown in FIG. 4, the cable 20 is provided with a core wire 22 made of conductor and an outer sheath 24 made of insulator. The outer sheath 24 covers the core wire 22. In the present embodiment, the core wire 22 of the cable 20 is made of aluminum or aluminum alloy. However, the present invention is not limited thereto. The core wire 22 may be made of another metal.

Figure 5:
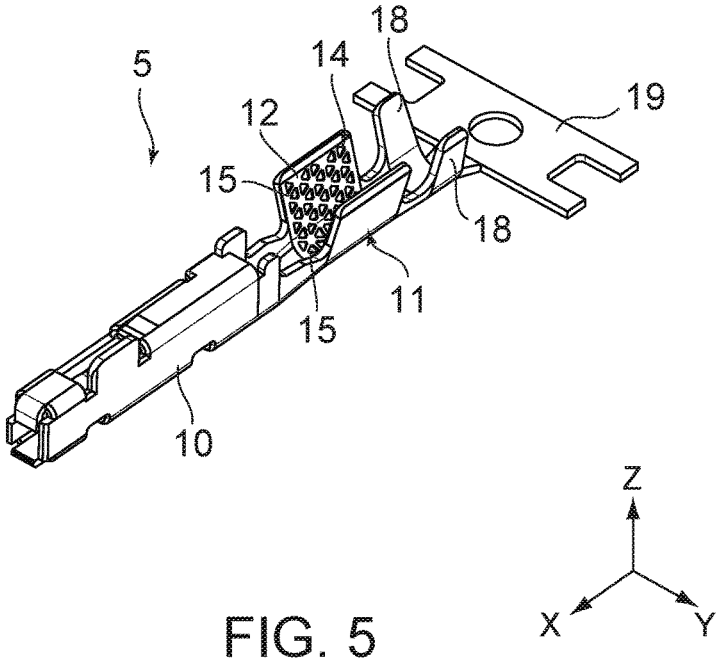
FIG. 5 is another perspective view showing the crimp terminal of FIG. 4. The crimp terminal is not cut off from a carrier yet, and the cable is not connected to the crimp terminal. A crimp barrel is in a state before crimped.

As shown in FIGS. 4 and 5, the crimp terminal 5 is obtained by punching out a metal sheet and bending the punched out metal sheet. That is, the crimp terminal 5 of the present embodiment is not a combination of plural components but a single component. The crimp terminal 5 is cut off from a carrier 19 after the bending process. The crimp terminal 5 illustrated has a socket portion 10, a crimp barrel 11 and a cable holding portion 18. The socket portion 10 is to be connected to a mating contact (not shown) of a mating connector (not shown). The crimp barrel 11 is for holding the core wire 22. The cable holding portion 18 is for holding the cable 20 over the outer sheath 24. In detail, the crimp barrel 11 is wound on and crimped onto the core wire 22 of the cable 20. The cable holding portion 18 is crimped to be wound on the outer sheath 24 of the cable 20. As understood from FIGS. 4 and 5, the core wire 22 of the cable 20 is located to extend in the front-rear direction (the longitudinal direction) on an inner surface 12 of the crimp barrel 11. By crimping the crimp barrel 11 onto the core wire 22 so as to be wound on the core wire 22, the crimp terminal 5 is connected to the cable 20.

Figure 6:
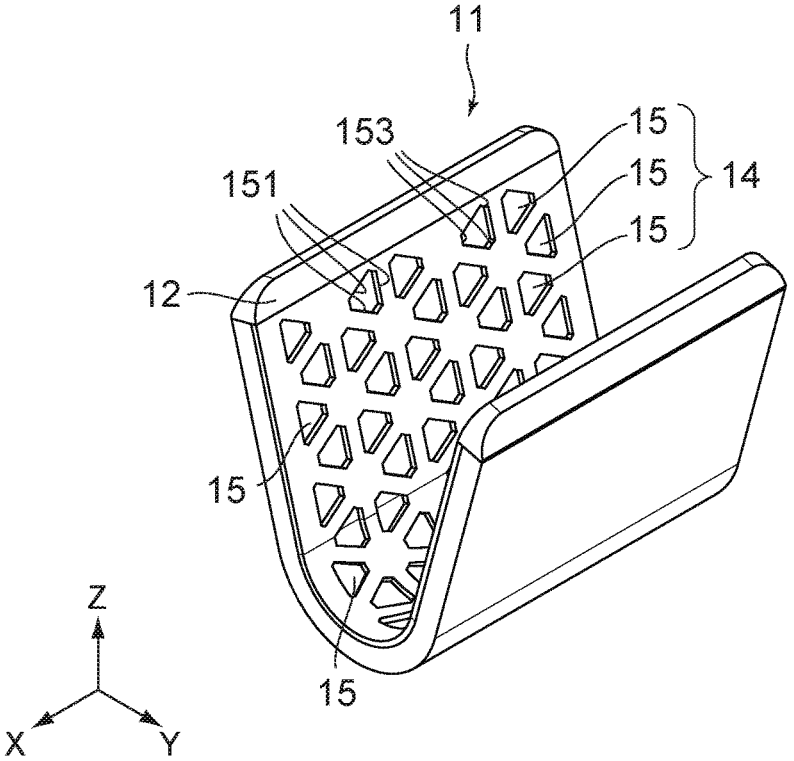
FIG. 6 is a perspective view schematically showing nothing but the crimp barrel of the crimp terminal of FIG. 5.

As shown in FIGS. 5 and 6, in the inner surface 12 of the crimp barrel 11, a serration 14 having a plurality of cavities 15 which are independent from one another is formed. The plurality of the cavities 15 increases friction resistance to a contact surface of the core wire (electric wire) 22 when the crimp barrel 11 is crimped onto the core wire 22. This brings effect to suppress attenuation, caused by plastic flow, of the core wire 22 positioned in the crimp barrel 11. Furthermore, the cavities 15 also suppress extension of the core wire 22 in the front-rear direction when the crimp barrel 11 is crimped. Accordingly, the attenuation of the core wire 22 positioned in the crimp barrel 11 is less, and reduction of crimping strength is suppressed. Therefore, stable electric connection performance is maintained.

Each of the cavities 15 of the serration 14 of the present embodiment has a predetermined shape which satisfies following three requirements in a plane orthogonal to a depth direction of the cavities 15 (or a plane orthogonal to a thickness direction of the metal sheet forming the crimp terminal 5) in a state before the crimp barrel 11 is crimped onto the core wire 22 (or in a state shown in FIGS. 5 and 6). [Requirement 1] The predetermined shape has, as components thereof, at least two straight portions and a concave curved portion connecting the two straight portions to each other; [Requirement 2] The concave curved portion is indented inward of the predetermined shape; and [Requirement 3] A plurality of the concave curved portions which are close to each other are positioned on the same imaginary circle or rounded rectangular.

The requirement 1 for the predetermined shape means that the predetermined shape includes at least one concave curved portion. Moreover, the requirement 1 means that both ends of the concave curved portion are connected to the straight portions, respectively. The requirement 1 does not deny that the straight portions are connected to each other. The straight portions included in the predetermined shape may be three or more in number. The number of the concave curved portions included in the predetermined shape is equal to or smaller than the number of the straight portions included in the predetermined shape. When the number of the straight portions is equal to the number of the concave curved portions in the predetermined shape, the straight portions and the concave curved portions are alternately connected to one another.

The requirement 2 for the predetermined shape clarifies that the concave curved portion does not protrude outward of the predetermined shape. The requirement 2 also means that an imaginary line segment is positioned outside the predetermined shape when the imaginary line segment connecting the both ends of the concave curved portion is assumed.

The requirement 3 for the predetermined shape means that the concave curved portion is a part of an imaginary circle (e.g. an arc) or a part of an imaginary rounded rectangular (e.g. a combination of an arc and straight lines) and that the imaginary circle or rounded rectangular is shared by the concave curved portions which are close to each other. As understood from this description, each of the concave curved portions is the arc in the case of the part of the imaginary circle or the arc and the straight lines which are connected to one another in the case of the part of the rounded rectangular. Accordingly, a portion consisting of straight lines connected to each other is excluded from scope of the concave curved portion even though the portion is indented. In the present specification, the concave curved portions which are close to each other and belong respectively to the different cavities distinct from each other. That is, in the present specification, even when a plurality of the concave curved portions are included in one of the predetermined shapes and a distance between the concave curved portions of one predetermined shape is smaller than a distance between one of the concave curved portions of one predetermined shape and another concave curved portion of another predetermined shape, the concave curved portions of one predetermined shape does not meet the terms of the Requirement 3, "the concave curved portions are close to each other". Furthermore, in the present specification, the terms of "rounded rectangular" designates a shape that is formed by a pair of parallel straight lines and a pair of half circles each of which connects ends of the parallel straight lines and protrudes outward.

Manufacturing a die used for forming the cavities 15 having the predetermined shape satisfying the requirements 1 to 3 is realized by linear cutting processes and circular drilling processes as described later with reference to FIG. 8. In other words, the manufacturing of the die needs neither a curvilinear cutting process nor an electric discharge machining process using an electrode having a complicated shape in order to round off corner portions. Accordingly, employing the serration 14 formed with the cavities 15 having the predetermined shape satisfying the requirements 1 to 3 facilitates the manufacturing of the die for forming the serration 14.

Figure 7:
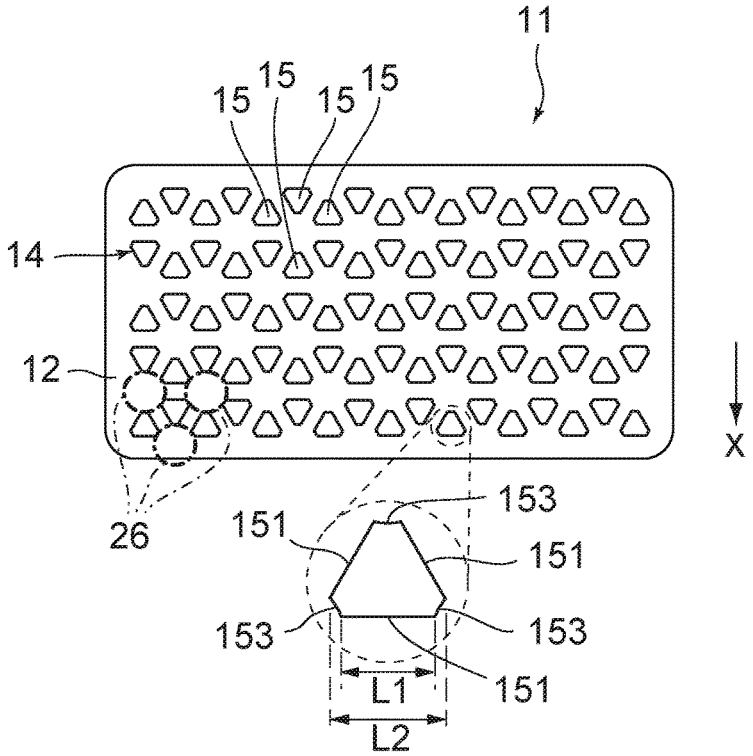
FIG. 7 is a plan view showing a serration formed to the crimp barrel of FIG. 6. One of cavities included in the serration is expanded and illustrated in a broken line circle. Moreover, in order to show that concave curved portions of a plurality of the cavities are on the same imaginary circle, the imaginary circles are designated by dashed lines.

As shown in FIGS. 6 and 7, the predetermined shape of the cavities 15 of the present embodiment is an approximately equilateral triangle in which all corner portions are cut off in arc shape. In other words, the predetermined shape is formed by connecting three straight portions 151 and three concave curved portions 153 to one another alternately. Each of the concave curved portions 153 connects two of the straight portions 151 to each other. The concave curved portions 153 are indented inward of the approximately equilateral triangle (the predetermined shape). Each of the straight portions 151 has a length L1. Two of the concave curved portions 153 are connected to both ends of the straight portion 151. The two concave curved portions 153 have near ends connected to the straight portion 151 and far ends far from the straight portion 151 connected thereto. The far ends define a distance L2 therebetween. The length L1 is shorter than the distance L2. All of the cavities 15 has a structure (shape and size) same as one another. However, the present invention is not limited thereto. Provided that the requirements 1 to 3 are satisfied, the predetermined shape of the cavities 15 may be a shape other than the approximately equilateral triangle. For example, the predetermined shape may be an approximately polygon or an approximately triangle except for the approximately equilateral triangle. In the approximately polygon or the approximately triangle, corners or parts of edges are cut off in arc. Furthermore, the cavities 15 may be different from one another in structure (shape and size). For example, a plurality of shapes of the cavities 15 may be mixed in the serration 14.

As understood from FIGS. 6 and 7, in the present embodiment, the cavities 15 are arranged in two dimension regularly. A cavity row that a plurality of the cavities 15 are lined up can be seen along a direction that each of the straight portions 151 extends. Each of the cavities 15 is located so that one of the three straight portions 151 thereof is orthogonal to the front-rear direction. Hence, all the three straight portions 151 of each of the cavities 15 are intersect with the front-rear direction. Each of the cavities 15 is located so that at least one of the straight portions 151 thereof faces another one of the straight portions 151 of another one of the cavities 15 adjacent thereto. Each of the cavities 15 is adjacent to at most three of the other cavities 15. In the present embodiment, an interval between two of the cavities 15 adjacent to each other has a certain value regardless of the adjacent direction. However, the present invention is not limited thereto. The interval between two of the cavities 15 adjacent to each other may have a different value for each of the adjacent directions. Two of the cavities 15 adjacent to each other are in a rotational symmetric relation. In the present embodiment, the predetermined shape is the approximately equilateral triangle, and the interval of the cavities 15 adjacent to each other has the certain value. Accordingly, two of the cavities 15 adjacent to each other are also in a mirror symmetric relation. The concave curved portions 153, which belong to the cavities 15, respectively, but are close to each other, are positioned on a single imaginary circle 26. In the present embodiment, at most six of the concave curved portions 153 belonging to six of the cavities 15 are positioned on one of the imaginary circles 26.

When the crimp barrel 11 is crimped onto the core wire 22, the core wire 22 is pressed and deformed to be extended outward from the inside of the crimp barrel 11 in the front-rear direction. The straight portions 151 of the cavities 15 intersect with the front-rear direction. Accordingly, it can be suppressed that deformed part of the core wire 22 is moved outward from the inside of the crimp barrel 11. Moreover, the concave curved portions 153 function like the straight portions 151 and eliminate acute angle portions from the predetermined shape to prevent the acute angle portions from being squashed with deformation of the crimp barrel 11. Thus, the core wire 22 can be partly inserted into the cavities 15 when the crimp barrel 11 is crimped. As a result, electric and mechanical connection stability between the crimp barrel 11 and the core wire 22 is improved.

Figure 8:
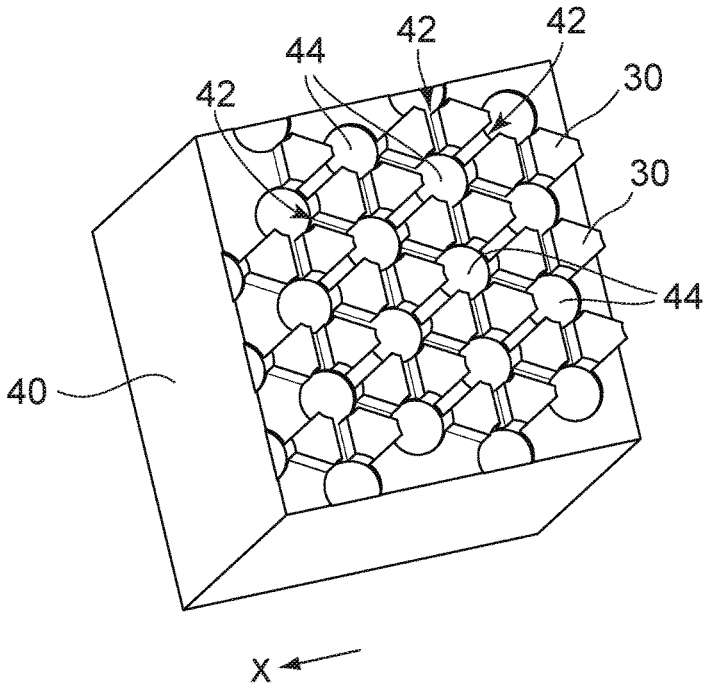
FIG. 8 is a perspective view showing a part of a die used for forming the serration of FIG. 7.

As shown in FIG. 8, the die used for forming the cavities 15 has a plurality of protrusions 30 corresponding to the cavities 15. These protrusions 30 can be formed by applying the linear cutting processes and the drilling processes to a surface of a metal block 40. In detail, a plurality of grooves 42 is formed in the surface of the metal block 40 along three different directions at first. In this event, the grooves 42 are formed so that portions remaining on the surface of the metal block 40 (remaining portions) have a plane shape of an equilateral triangle. Accordingly, in the present embodiment, the three different directions intersect with one another by an angle of 60 degrees, and intervals of the grooves 42 formed along the three different directions are equal to one another. The grooves 42 formed along each of the directions may have a width set freely. In the present embodiment, all widths of the grooves 42 are equal to one another. The grooves 42 can be formed by the simple and linear cutting processes. Next, holes 44 are formed by the drilling processes to remove corner portions of the remaining portions in plan view. The drilling process is performed at a time for a plurality of the corner portions which are close to each other. The circular drilling processes can be easily performed using a drill. Alternately, electric discharge machining processes may be performed using a cylindrical electrode. In the present embodiment, the circular drilling process is performed so that one processed area includes at most six corner portions. Owing to this drilling process, the concave curved portions 153 corresponding to the hole 44 are positioned on the same imaginary circle. By performing press processes using the die manufactured as stated above, the crimp barrel 11 having the serration 14 shown in FIG. 7 can be manufactured. As mentioned above, the die used for forming the serration 14 of the crimp terminal 5 according to the present embodiment can be easily manufactured by the linear cutting processes and the drilling processes using the drill.

Although the present invention is described based on the embodiment thereof, the present invention is not limited thereto. The present invention is applicable to various modification and alternatives.

Figure 9:
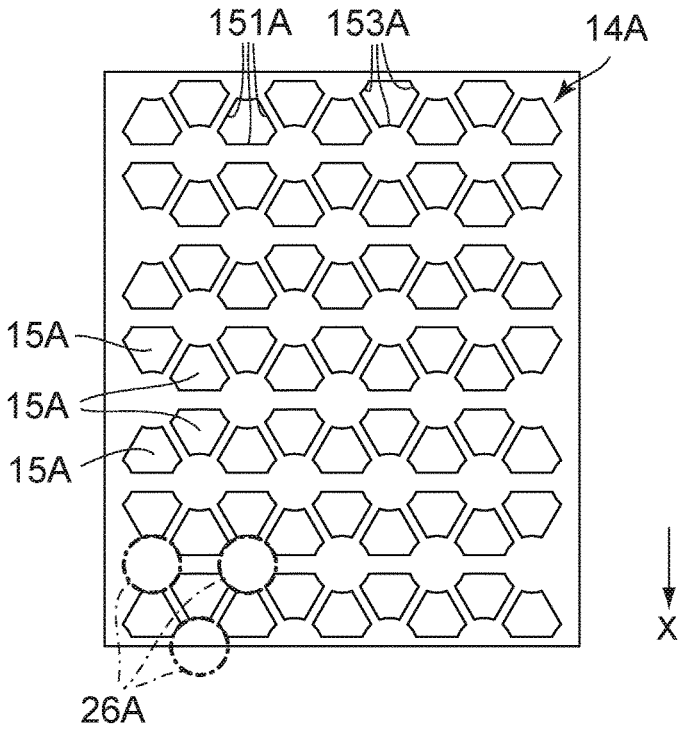
FIG. 9 is a diagram showing a part of a modification of the serration. An illustrated outer frame is irrelevant to an outer shape of the crimp barrel. Moreover, in order to show that concave curved portions of a plurality of cavities are on the same imaginary circle, the imaginary circles are designated by dashed lines.

In the aforementioned embodiment, the interval between two of the cavities 15 adjacent to each other has the certain value regardless of the adjacent direction. However, the present invention is not limited thereto. The interval between two of the cavities 15 adjacent to each other may be set for each of adjacent directions thereof. For example, in an example shown in FIG. 9, an interval between two of cavities 15A adjacent to each other in the front-rear direction is wider than intervals of the cavities 15A adjacent to each other in other adjacent directions. When the interval between two of the cavities 15A adjacent to each other is set for each of the adjacent directions, lengths of straight portions 151A and lengths of concave curved portions 153A depend on the intervals of the cavities 15A in the adjacent directions. Accordingly, there is a case where three of the straight portions 151A are different from one another in length. Similarly, there is a case where three of the concave curved portions 153A are different from one another in length. Even in such a case, a predetermined shape of each of the cavities 15A satisfies the requirements 1 to 3. In other words, a plurality of the concave curved portions 153A is positioned on the same imaginary circle 26A. Therefore, it is also easy to manufacture a die used for forming a serration 14A having such cavities 15A.

Figure 10:
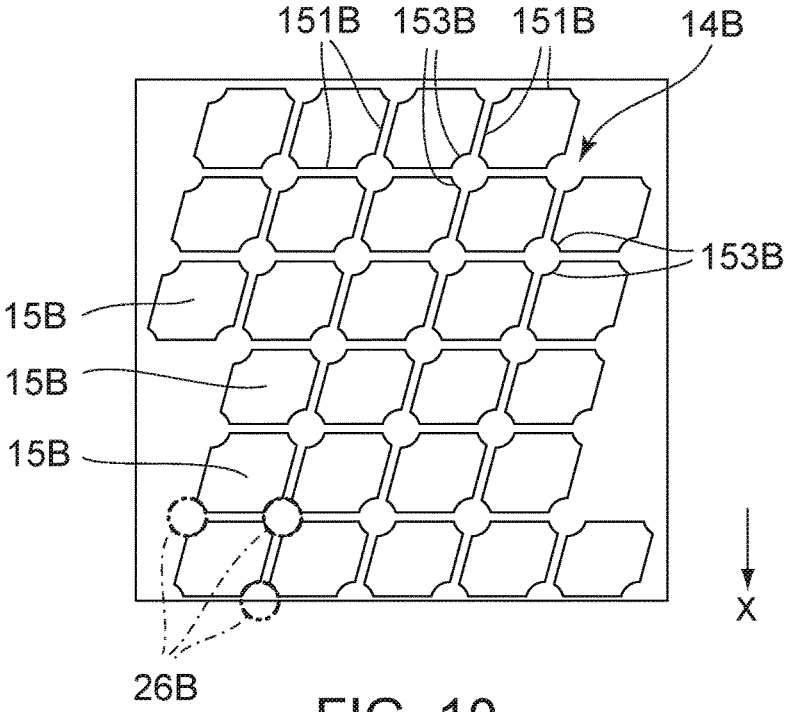
FIG. 10 is a diagram showing a part of another modification of the serration. An illustrated outer frame is irrelevant to the outer shape of the crimp barrel. Moreover, in order to show that concave curved portions of a plurality of cavities are on the same imaginary circle, the imaginary circles are designated by dashed lines.

Although the predetermined shape of the cavities 15 is the approximately equilateral triangle in the aforementioned embodiment, the present invention is not limited thereto. For example, as shown in FIG. 10, the predetermined shape of cavities 15B may be an approximately parallelogram. Even in this example, the predetermined shape of each of the cavities 15B satisfies the requirements 1 to 3. In detail, the predetermined shape of the cavities 15B has four straight portions 151B and four concave curved portions 153B, and the straight portions 151B and the concave curved portion 153B are alternately connected to one another. The cavities 15B are arranged in two dimensions along two directions in which the straight portions 151B extend. Moreover, the cavities 15B are located so that all of the straight portions 151B intersect with the front-rear direction. In the example of FIG. 10, a pair of the straight portions 151B is orthogonal to the front-rear direction. Each of the straight portions 151B of each of the cavities 15B faces another one of the straight portions 151B of another one of the cavities 15B adjacent thereto. In each of the cavities 15B, each of the four concave curved portions 153B faces any one of the other three concave curved portions 153B. In addition, the concave curved portions 153B, which belong to the cavities 15B, respectively, but are close to each other, are positioned on a single imaginary circle 26B. At most four of the concave curved portions 153B of four of the cavities 15B are positioned on one imaginary circle 26B. A die used for forming a serration 14B formed with the cavities 15B having the predetermined shape of such an approximately parallelogram can be also easily manufactured by the linear cutting processes and the drilling processes using the drill.

Figure 11:
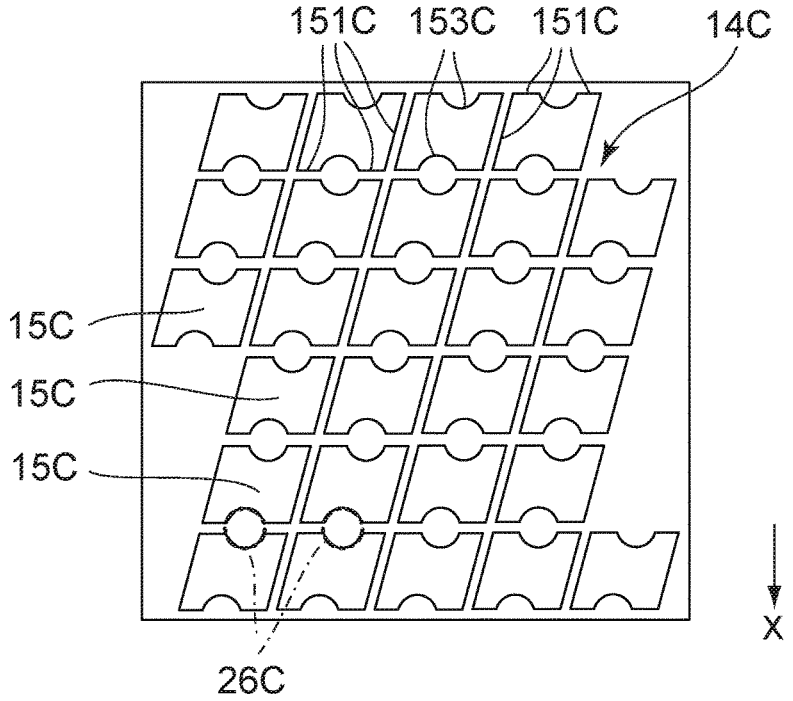
FIG. 11 is a diagram showing a part of still another modification of the serration. An illustrated outer frame is irrelevant to the outer shape of the crimp barrel. Moreover, in order to show that concave curved portions of a plurality of cavities are on the same imaginary circle, the imaginary circles are designated by dashed lines.

Although the concave curved portions 153 are provided in areas corresponding to corner portions of polygons in the aforementioned embodiment as shown in FIG. 7, the present invention is not limited thereto. The concave curved portions may be provided in areas corresponding to edges of the polygons. For example, in an example shown in FIG. 11, concave curved portions 153C are provided in areas corresponding to pairs of edges of parallelograms. Even in this example, a predetermined shape of each cavity 15C satisfies the requirements 1 to 3. In detail, the predetermined shape of the cavities 15C has six straight portions 151C and two concave curved portions 153C. Each of the concave curved portions 153C connects two of the straight portions 151C to each other. Moreover, each of the concave curved portions 153C is indented inward of the predetermined shape. The concave curved portions 153C, which belong to the cavities 15C, respectively, but are close to each other, are positioned on a single imaginary circle 26C. A die used for forming a serration 14C formed with such cavities 15C can be also easily manufactured by the linear cutting processes and the drilling processes using the drill.

Figure 12:
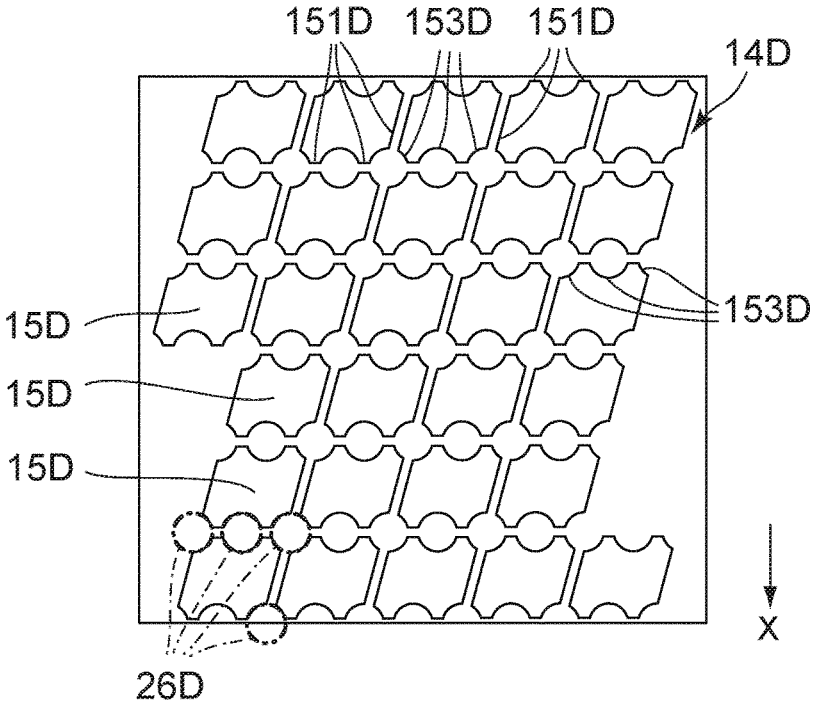
FIG. 12 is a diagram showing a part of yet still another modification of the serration. An illustrated outer frame is irrelevant to the outer shape of the crimp barrel. Moreover, in order to show that concave curved portions of a plurality of cavities are on the same imaginary circle, the imaginary circles are designated by dashed lines.
Figure 13:
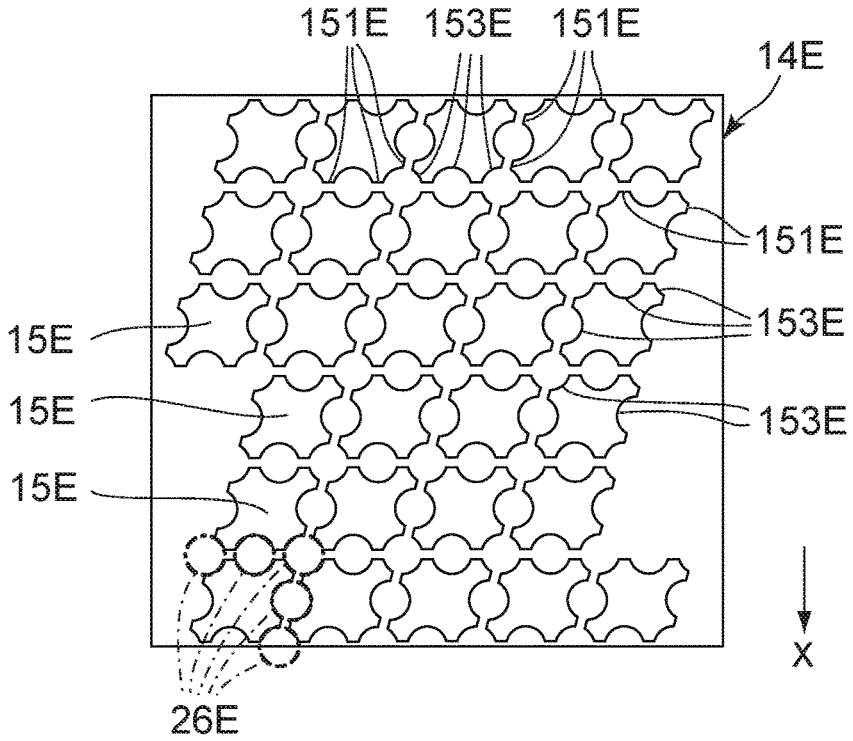
FIG. 13 is a diagram showing a part of further still another modification of the serration. An illustrated outer frame is irrelevant to the outer shape of the crimp barrel. Moreover, in order to show that concave curved portions of a plurality of cavities are on the same imaginary circle, the imaginary circles are designated by dashed lines.
Figure 14:
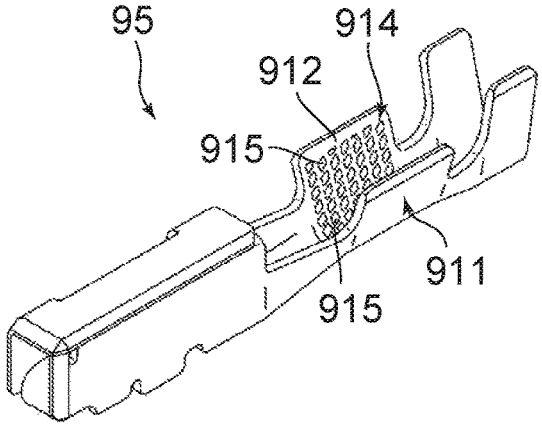
FIG. 14 PRIOR ART
FIG. 14 is a perspective view showing a crimp terminal of Patent Literature 1.
Figure 15:
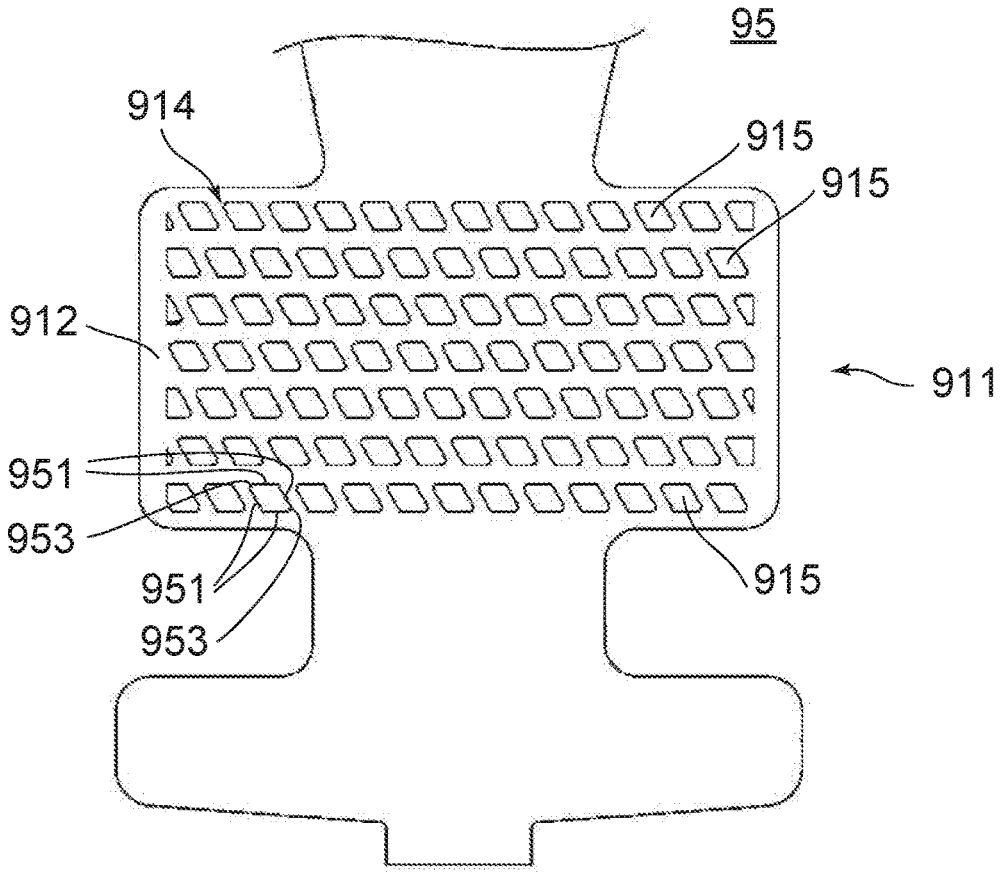
FIG. 15 PRIOR ART
FIG. 15 is a plan view showing a crimp portion, which is opened into a flat plate shape, of the crimp terminal of FIG. 14.

As shown in FIG. 12 or 13, concave curved portions 153D or 153E may be provided both in areas corresponding to corner portions of polygons and in areas corresponding to edges of the polygons. In the example shown in FIG. 12, a predetermined shape of cavities 15D has six straight portions 151D and the six concave curved portions 153D. Furthermore, in the example shown in FIG. 13, a predetermined shape of cavities 15E has eight straight portions 151E and the eight concave curved portions 153E. In each of the examples, the predetermined shape of each of the cavities 15D or 15E satisfies the requirements 1 to 3. In detail, the straight portions 151D or 151E and the concave curved portions 153D or 153E are alternately connected to one another. Each of the concave curved portions 153D or 153E is indented inward of the predetermined shape. The concave curved portions 153D or 153E, which belong to the cavities 15D or 15E, respectively, but are close to each other, are positioned on a single imaginary circle 26D or 26E. A die used for forming a serration 14D or 14E formed with such cavities 15D or 15E can be also easily manufactured by the linear cutting processes and the drilling processes using the drill.

It should be noted that FIGS. 9 to 13 are merely used for description of the predetermined shapes and arranged patterns of the cavities 15A to 15E and show only parts of serrations 14A to 14E formed in the crimp barrels 11. Practically, the serrations 14A to 14E formed in the crimp barrels 11 further continue in a direction orthogonal to the X-direction (in a right-left direction in each of the figures). The present invention is not limited to the examples shown in FIGS. 9 to 13. The number and size of the cavities 15A to 15E and the number of the cavity rows formed by the cavities 15A to 15E may be set freely.

Although the concave curved portions 153 which are close to each other are positioned on the same imaginary circle 26 in the aforementioned embodiment, they may be positioned on the same imaginary rounded rectangular. In an example of a case where the concave curved portions 153 close to each other are positioned on the same imaginary rounded rectangular, the intervals of the cavities 15 might be different according to adjacent directions. Also in this case, manufacturing a die can be easily performed by the linear cutting process and the drilling process using the drill. A rounded rectangular can be easily formed by moving the drill linearly while drilling using the drill. Additionally, even when the shape of the concave curved portion is a part of an ellipse or a part of a polygon having a lot of apexes (ex. eight or more apexes), effect same as in the case of the part of the circle or the rounded rectangle can be obtained. However, it is desirable that the shape of the concave curved portion is the part of the circle or the part of the rounded rectangular from the viewpoint of easiness of manufacturing the die.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A crimp terminal having a crimp barrel to be crimped onto a core wire of a cable, wherein:

the crimp barrel has an inner surface in which a plurality of cavities which are independent from each other is formed;

each of the cavities has a predetermined shape in a plane orthogonal to a depth direction thereof before the crimp barrel is crimped;

the predetermined shape has at least two straight portions and a concave curved portion connecting the straight portions to each other;

the concave curved portion is indented inward of the predetermined shape; and a plurality of the concave curved portions which are close to each other and included respectively in the predetermined shapes independent from each other is arranged on an identical imaginary circle or rounded rectangular.

2. The crimp terminal as recited in claim 1, wherein each of the straight portions extends in a direction intersecting with a longitudinal direction of the crimp terminal.

3. The crimp terminal as recited in claim 2, wherein:

the straight portions included in the predetermined shape are three or more in number;

the concave curved portions included in the predetermined shape are equal in number to the straight portions included in the predetermined shape; and the predetermined shape is a shape in which the straight portions and the concave curved portions are alternately connected to each other.

4. The crimp terminal as recited in claim 3, wherein:

each of the straight portions is connected to two of the concave curved portions at both end thereof;

the two concave curved portions have near ends connected to the both ends of the straight portion, respectively, and far ends far from the straight portion connected thereto;

each of the straight portions has a length; and the length of the straight portion is shorter than a distance between the far ends of the two concave curved portions connected to the straight portion.

5. The crimp terminal as recited in claim 3, wherein:

the straight portions included in the predetermined shape is an even number in number; and each of the concave curved portions faces another one of the concave curved portions in the predetermined shape.

6. A connector comprising:

the crimp terminal as recited in claim 1; and a holding member which holds the crimp terminal.

* * * * *